US006638020B1

(12) United States Patent
Tsui

(10) Patent No.: US 6,638,020 B1
(45) Date of Patent: Oct. 28, 2003

(54) SPIRAL FLUTED WHEEL FOR A WATER PUMP

(75) Inventor: Su-Chen Tsui, Taichung Hsien (TW)

(73) Assignee: Sea Chung Electric Co., Ltd., Taichung Hsien (TW)

( * ) Notice: Subject to any disclaimer, the term of this patent is extended or adjusted under 35 U.S.C. 154(b) by 20 days.

(21) Appl. No.: 10/123,149

(22) Filed: Apr. 17, 2002

(51) Int. Cl.[7] ..... F04D 29/24
(52) U.S. Cl. ..... 416/185; 416/214 R; 416/223 B
(58) Field of Search ..... 416/182, 183, 416/185, 186 R, 213 A, 213 R, 214, 220 R, 223 B, 179, 212 R; 415/206

(56) References Cited

U.S. PATENT DOCUMENTS 3,362,338 A * 1/1968 Stethem ..... 416/183
6,176,680 B1 * 1/2001 Ringblom et al. ..... 416/212 R
6,220,819 B1 * 4/2001 Chien et al. ..... 416/186 R

* cited by examiner

*Primary Examiner*—Edward K. Look
*Assistant Examiner*—Dwayne J. White
(74) *Attorney, Agent, or Firm*—Rabin & Berdo, P.C.

(57) ABSTRACT

A spiral fluted wheel has a top plate, a bottom plate and multiple spiral impellers. The spiral impellers are sandwiched between the top plate and the bottom plate to combine the top plate and the bottom plate together. Each spiral impeller has two wedges to complementary engage with another wedge of an adjacent spiral impeller. At least one male engaging element is formed on one wedge of each spiral impeller, and a female engaging portion is defined in the other wedge to engage with each respective male engaging element on the adjacent spiral impeller. Accordingly, the spiral fluted wheel can be combined rapidly and precisely.

2 Claims, 3 Drawing Sheets

SPIRAL FLUTED WHEEL FOR A WATER PUMP

BACKGROUND OF THE INVENTION

1. Field of the Invention

The present invention relates to a spiral fluted wheel, and more particularly to a spiral fluted wheel for a water pump and that can be produced rapidly and precisely.

2. Description of Related Art

With reference to FIG. 3, a spiral fluted wheel for a water pump in accordance with the prior art comprises a top plate (40), a bottom plate (41), and multiple spiral impellers (42). The top plate (40) is a disc and has a lock hole (not numbered) defined in the center of the top plate (40). The lock hole is adapted to be securely attached on an axle of the water pump to make the spiral fluted wheel rotate with the axle. The bottom plate (41) is also a disc and has an inlet aperture (not numbered) defined in the center of the bottom plate (41). The inlet aperture has a larger diameter than a diameter of the axle to define a gap between the inlet aperture of the bottom plate (41) and the axle for water entering into the spiral fluted wheel.

The multiple spiral impellers (42) are sandwiched between the top plate (40) and the bottom plate (41) and define a plurality of channels between the top plate (40) and the bottom plate (41). Each spiral impeller (42) is partially spiral-shaped and a spiral channel is defined in a middle portion of the spiral impeller (42). The spiral impeller (42) has a flat bottom (43) and two opposite thin side-walls (not numbered) erected on the flat bottom (43) to construct and surround the spiral channel. Each side-wall has a wedge (44) extending laterally and outwardly from a top of the side wall. In practice, the flat bottom (43) is welded to the upper face of the bottom plate (41) and the wedges (44) are welded to the lower face of the top plate (40) to form a sandwich layer between the top plate (40) and the bottom plate (41).

However, because the spiral impellers (42) are not combined with each other, welding the thin and fiddly spiral impellers (42) one by one to the top plate (40) and the bottom plate (41) is troublesome and time-wasting. In addition, the combination of the spiral impellers is not precise because the spiral impellers abut with each other but do not combine with the other.

To overcome the shortcomings, the present invention tends to provide a spiral fluted wheel to mitigate or obviate the aforementioned problems.

SUMMARY OF THE INVENTION

The main objective of the invention is to provide a spiral fluted wheel for a pump that can be combined rapidly and precisely. The spiral fluted wheel has a top plate, a bottom plate and multiple spiral impellers. The spiral impellers are sandwiched between the top plate and the bottom plate to combine the top plate and the bottom plate together. Each spiral impeller has two wedges to complementarily engage with another wedge of an adjacent spiral impeller. At least one male engaging element is formed on one wedge of each spiral impeller, and a female engaging portion is defined in the other wedge to engage with each respective male engaging element on the adjacent spiral impeller. With the arrangements of the male engaging elements and the female engaging portions, the spiral fluted wheel can be combined rapidly and precisely.

Other objects, advantages and novel features of the invention will become more apparent from the following detailed description when taken in conjunction with the accompanying drawings.

DETAILED DESCRIPTION OF PREFERRED EMBODIMENT

Figure 1:
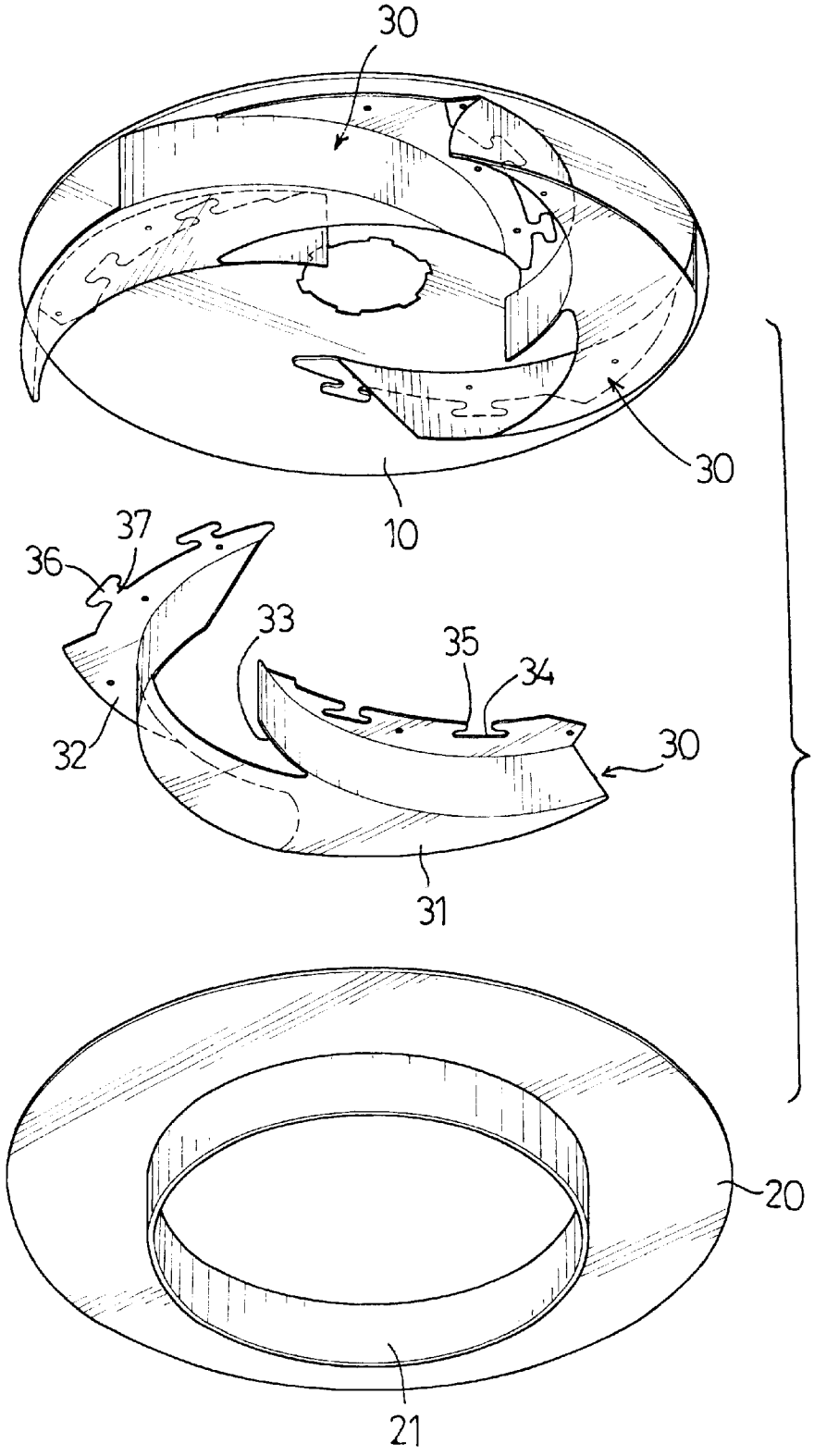
FIG. 1 is an exploded perspective view of a spiral fluted wheel in accordance with the present invention.
Figure 2:
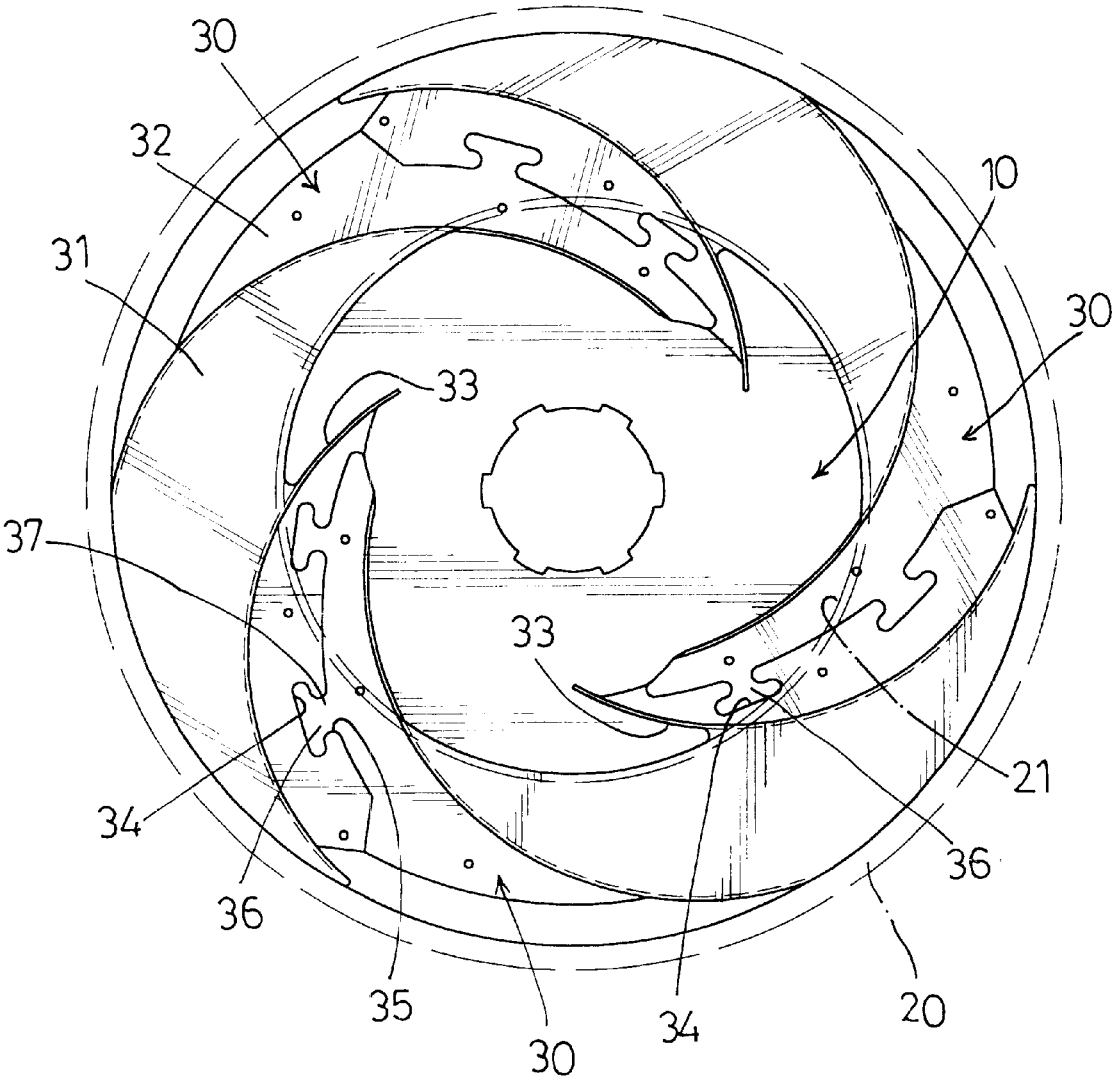
FIG. 2 is a bottom plane view of the spiral fluted wheel in FIG. 1.
Figure 3:
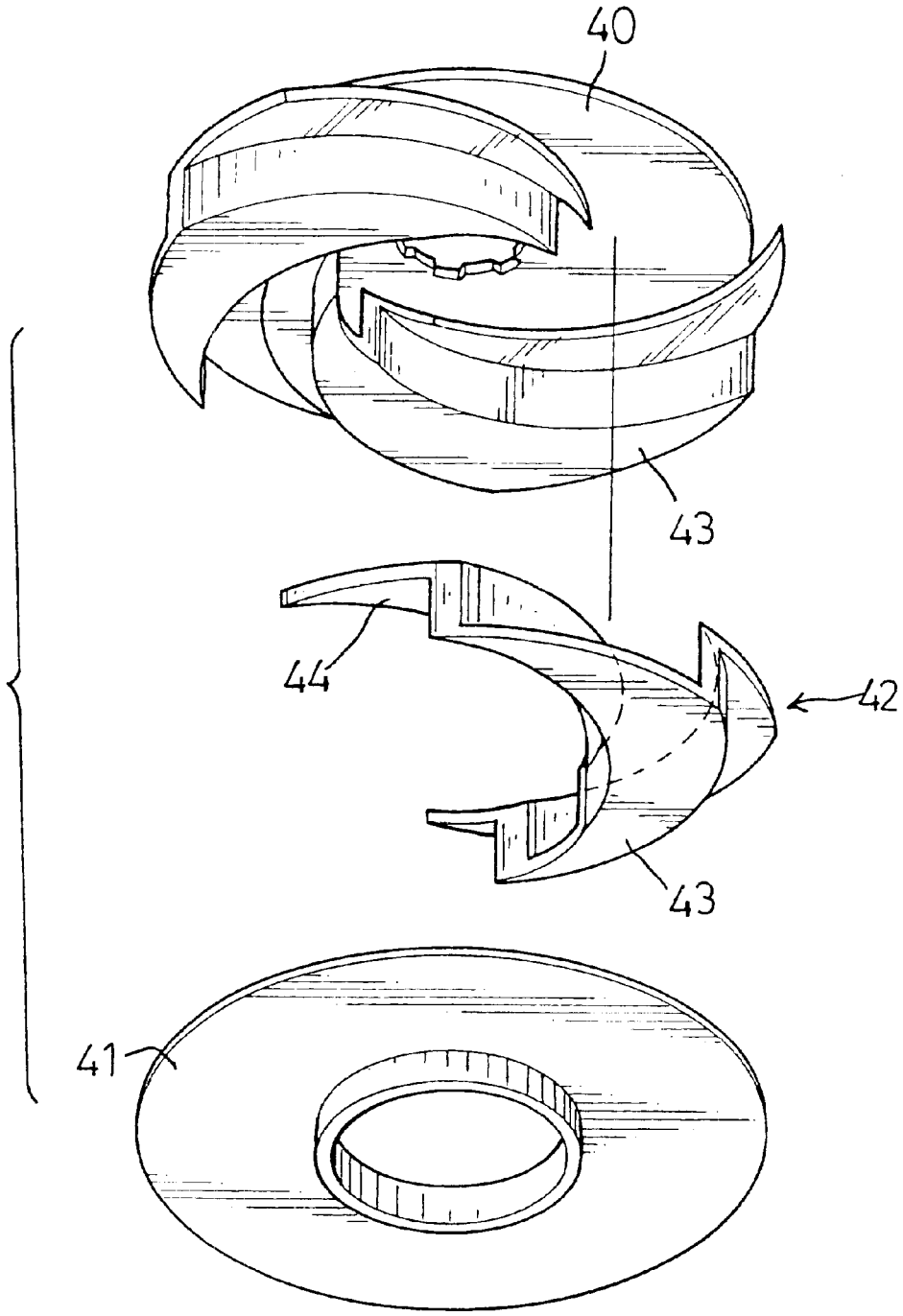
FIG. 3 PRIOR ART
FIG. 3 is an exploded perspective view of a conventional spiral fluted wheel in accordance with the prior art.

With reference to FIGS. 1 and 2, a spiral fluted wheel for a water pump in accordance with the present invention comprises a top plate (10), a bottom plate (20), and multiple spiral impellers (30). The top plate (10) is a disc and has a lock hole (not numbered) defined in the center of the top plate (10). The lock hole is adapted to be securely attached on an axle (not shown) of the water pump to make the spiral fluted wheel rotate with the axle. The bottom plate (20) is also a disc and has an inlet aperture (21) defined in the center of the bottom plate (20). The inlet aperture (21) has a diameter larger than a diameter of the axle to define a gap between the inlet aperture (21) in the bottom plate (20) and the axle for water entering into the spiral fluted wheel.

The spiral impellers (30) are combined together to form a sandwich layer with a plurality of channels between the top plate (10) and the bottom plate (20). Each spiral impeller (30) is partially spiral-shaped and a spiral channel (not numbered) is defined in a middle portion of the spiral impeller (30). Each spiral impeller (30) has a flat bottom (31) and two opposite thin side-walls (not numbered) erected on the flat bottom to construct and surround the spiral channel. An opening (33) is defined between the side-walls at one end of the spiral impeller (30) and communicates with the spiral channel, such that the water can flow into the spiral channel through the opening (33).

A wedge (32) extends laterally and outwardly from a top of each respective side-wall to complementary engage with another wedge (32) of the adjacent spiral impeller (30). One wedge (32) of each spiral impeller (30) has two male engaging elements (36) extending outward from the wedge (32). The other wedge (32) of each spiral impeller (30) has a female engaging portion (34) defined in the free edge of the wedge (32) to engage with each respective male engaging element (36) on the adjacent spiral impeller. In practice, each male engaging element is a T-shaped tab and has a neck (37). Each female engaging portion (34) is a T-shaped recess and has an opening (35) to engage with the corresponding one of the male engaging elements on the adjacent spiral impeller.

Accordingly, the spiral impellers (30) can be securely assembled with each other to form the sandwich layer between the top plate (10) and the bottom plate (20). A required quantity of the spiral impellers (30) is combined to compose a round combination by fitting the male engaging elements (36) into the female engaging portion (34) of the adjacent spiral impeller (30) together. This makes the combination of the sandwich layer made by the spiral impellers (30) precise and easy to construct. Furthermore, to combine the integral sandwich layer made by the spiral impellers (30) between the top plate (10) and the bottom plate (20) with a welding process is convenient and precise.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A spiral fluted wheel for a water pump comprising:

a top plate having a lock hole defined in a center of the top plate and adapted to be firmly secured on a rotating device of the water pump;

a bottom plate corresponding to the top plate and having an inlet aperture defined in a center of the bottom plate for entry of water into the spiral fluted wheel; and multiple spiral impellers sandwiched between the top plate and the bottom plate, each spiral impeller having a spiral channel defined therein and a first wedge and a second wedge laterally extending and complementary engaged to another wedge of an adjacent spiral impeller, wherein the first wedge of each spiral impeller has at least one male engaging element extending outward from the wedge; and the second wedge of each spiral impeller has a female engaging portion defined in a free edge of the second wedge to engage with each respective at least one male engaging element on the first wedge of the adjacent spiral impeller.

2. The spiral fluted wheel as claimed in claim 1, wherein each at least one male engaging element on the first wedge is a T-shaped tab; and each female engaging portion in the second wedge is a T-shaped recess to engage with the corresponding at least one male engaging element on the adjacent spiral impeller.

* * * * *